US006457988B1

(12) United States Patent
Andersen

(10) Patent No.: US 6,457,988 B1
(45) Date of Patent: Oct. 1, 2002

(54) ELECTRICAL CONNECTOR

(75) Inventor: Svend Andersen, Emigrant, MT (US)

(73) Assignee: Richard S. Eisen, Northbrook, IL (US); a part interest ( * ) Notice: Subject to any disclaimer, the term of this patent is extended or adjusted under 35 U.S.C. 154(b) by 0 days.

(21) Appl. No.: 09/746,889

(22) Filed: Dec. 21, 2000

(51) Int. Cl.[7] ..... H01R 13/62

(52) U.S. Cl. ..... 439/373; 439/137; 439/291; 439/460; 439/651

(58) Field of Search ..... 439/136–140, 439/290–292, 284, 286–287, 342, 455, 460, 677, 217–218, 221–222, 687, 373, 651

(56) References Cited

U.S. PATENT DOCUMENTS

| | | | | | |
|---|---|---|---|---|---|
| 1,967,021 | A | * | 7/1934 | Gary | 439/677 |
| 3,314,043 | A | * | 4/1967 | Carissimi | 439/217 |
| 3,904,265 | A | * | 9/1975 | Hollyday et al. | 439/687 |
| 4,209,661 | A | * | 6/1980 | Pate et al. | 439/460 |
| 4,445,741 | A | * | 5/1984 | Annoot | 439/290 |
| 4,660,913 | A | | 4/1987 | Turner | |
| 5,080,608 | A | * | 1/1992 | Yarnton et al. | 439/460 |
| 5,277,602 | A | | 1/1994 | Yi | |
| 5,454,729 | A | * | 10/1995 | Wen-Te | 439/357 |
| 5,478,249 | A | * | 12/1995 | Crestin | 439/138 |
| 5,586,898 | A | * | 12/1996 | Anderson et al. | 439/287 |
| 5,704,811 | A | | 1/1998 | Hsu | |
| 5,775,921 | A | | 7/1998 | Chou | |
| 5,839,909 | A | * | 11/1998 | Calderana et al. | 439/137 |
| 5,885,098 | A | * | 3/1999 | Witkowski | 439/136 |
| 5,951,309 | A | * | 9/1999 | Hopper | 439/136 |
| 6,074,252 | A | | 6/2000 | Grieve | |

* cited by examiner

*Primary Examiner*—Gary R. Paumen
*Assistant Examiner*—Felix O. Figueroa
(74) *Attorney, Agent, or Firm*—Lloyd L. Zickert

(57) ABSTRACT

An electrical connector for securely maintaining the connector members in mated relation to allow for a continuous electrical connection. The electrical connector includes a male connector member or plug having a series of prongs and a female connector member or wall outlet box having a series of sockets that extend vertically for accepting the prongs. Each of the connector members is connected to an electric cable and may have a pair of wedges having serrated opposed sides to retain the cable within the connector member.

4 Claims, 3 Drawing Sheets

ELECTRICAL CONNECTOR

DESCRIPTION

This invention relates in general to an electrical connector that securely maintains a male electrical connector member or plug in mated relation with a female electrical connector member (e.g., an electrical outlet box) during use, and more particularly to an electrical connector having a male connector member with a series of prongs that mate with respective sockets on a female connector member such that the prongs and sockets are aligned to prevent any accidental or unwanted unmating of the connector.

BACKGROUND OF THE INVENTION

Heretofore, it has been well know to provide an electrical connector for connecting a male member, or plug, to a female member such as an outlet box, to supply electrical power to operate various devices or machinery. These prior known electrical connectors include a plug that has a series of blades and/or prongs that are matingly received by a series of slots and/or sockets on the female member. The plug and female member of these prior connectors are connected by axially pushing the plug and female member together and are disconnected by pulling the plug away from the female member.

These electrical connectors pose potential problems in the inability of the connectors to securely maintain an electrical connection during use. For example, one may accidentally disengage an electrical connection by creating tension in the electrical cable (e.g., when the device being used is pulled beyond the length of the electric cable). Losing an electrical connection creates an inconvenience in some circumstances when using, for example, power tools, and it could lead to unnecessary losses or damages when using devices such as computers or refrigerators. Additionally, unwanted losses of electrical connections could lead to greater damages or injury when using medical and/or industrial equipment. Therefore, there is a need for an electrical connector that will remain securely engaged to provide a continuous electrical connection.

SUMMARY OF THE INVENTION

The electrical connector of the present invention is an improvement over the prior electrical connectors in that the way that the plug and outlet box mate is unique and an improvement over the prior art. In particular, the sockets on the outlet box are substantially vertically aligned so that when the prongs of the plug are inserted into the sockets, the plug is securely maintained within the outlet box and cannot be accidentally removed by axial forces (e.g., sudden pulls) applied to an electric cable or extension cord connected to the plug. Additionally, the outlet box may have a spring-biased cover plate that selectively covets the sockets of the outlet box when the outlet box is not in use. It is also appreciated that the electrical connector of the invention may be used with other electrical connections such as extension cords.

It is therefore an object of the present invention to provide a new and improved electrical connector that securely maintains the male connector member in mated relation with the female connector member.

A further object of the present invention is to provide an electrical connector that includes a male member having a series of prongs that mate with a series of sockets on a female member to prevent the male member from being accidentally pulled out of engagement with the female member.

It is yet a further object of the present invention to provide a new and improved electrical connector that protects against children having access to the electrical sockets by including a retractable cover plate to selectively cover the sockets of the female connector member when the connector is not in use.

Other objects, features and advantages of the invention will be apparent from the following detailed disclosure, taken in conjunction with the accompanying sheets of drawings, wherein like reference numerals refer to like parts.

DETAILED DESCRIPTION OF THE INVENTION

Figure 1:
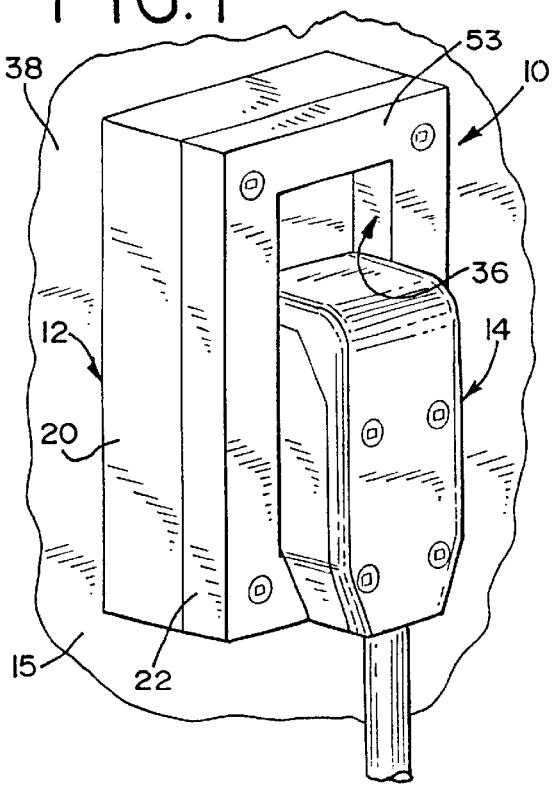
FIG. 1 is a perspective view of an electrical connector according to the present invention showing the male connector member or plug in engagement with the female connector member or wall outlet box.

Referring now to the drawings, and particularly to the embodiment of FIGS. 1 to 6, the improved electrical connector of the present invention, generally designated by the numeral 10, is illustrated having a female member or wall outlet box 12, and a male member or plug 14. While each of the electrical connector members is shown as being connected to an electric cable having three wires, it is appreciated that the electrical connector may work in conjunction with electrical cables having a different number of wires.

The outlet box generally comprises an insulated housing having a plurality of sockets situated within a cavity. A retractable cover plate covers the sockets when the outlet box is not in use. Each of the sockets is electrically connected to a wire of an electric cable to allow electricity to be conducted between the members when prongs of the plug are inserted into the sockets. The housing of the outlet box is preferably molded of an insulating plastic such as a polypropylene or a rubber, but it is appreciated that it may be of any insulative material suitable for use in an electrical connector.

Figure 3:
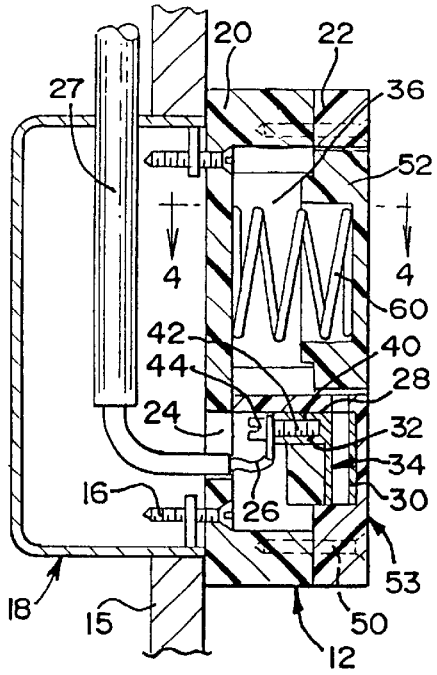
FIG. 3 is a vertical sectional view of the outlet box taken substantially along line 3—3 of FIG. 2 showing a wire of an electric cable connected to one of the sockets.
Figure 2:
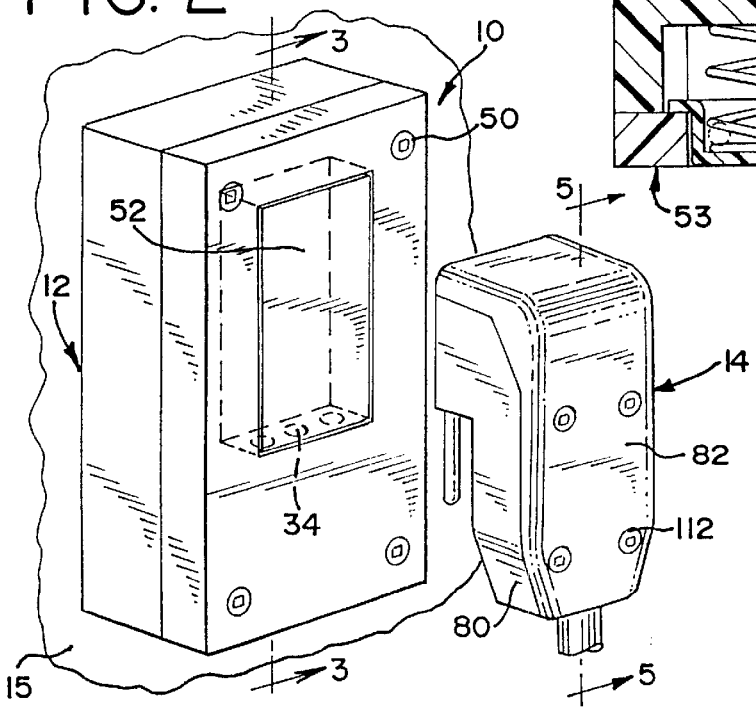
FIG. 2 is a perspective view of the plug and outlet box with the plug removed from the outlet box showing a cover plate on the outlet box biased into closed position to cover the sockets of the outlet box and showing the sockets in the cavity of the outlet box in phantom.

As shown in FIGS. 1 to 3, the housing of the outlet box 12 includes a base 20 and a top 22. The base of the outlet box is illustrated as being attached to a structure or wall 15 through a pair of screws 16 that connect to a suitable anchored electrical box 18, although it is appreciated that the outlet box may also be recessed in and flush with the exterior face of the wall. Additionally, while the base of the outlet box is shown as rectangularly shaped, it may be of any size or shape and not depart from the scope of the present invention.

On the underside of the base is an aperture 24 that allows a plurality of wires 26 from an electric cable 27 to pass through and be electrically and mechanically connected to a plurality of conductive contacts 28. The contacts are preferably substantially L-shaped having a base 30 and a stem 32, although it is appreciated that they may be of any shape that allows electricity to be conducted from the wires to the prongs, and may be made of multiple abutting parts. The base 30 of each of the contacts includes a socket 34 that extends the length of the contact base 30 and is designed to frictionally engage a prong of the plug. As shown in FIG. 3 and in phantom in FIG. 2, the sockets are preferable located within a cavity 36 in the base and extend substantially vertically when the housing is attached to a vertical wall 15. While the sockets are shown as recessed within the cavity of the outlet box, it is appreciated that the sockets may be externally located such that they would protrude from the wall and base of the outlet box. Additionally, while the sockets are shown as substantially cylindrical in shape, they may be of any cross-sectional shape to allow the prongs of the plug to frictionally fit within the respective sockets.

The stem 32 of the contact has a threaded hole 40 for receiving a screw 42 that connects one of the wires 26 to its respective contact 28. To connect the wire to its respective contact, the end of the wire, which is exposed by removing the wire's insulation, is wrapped around the screw or placed beneath the head 44 of the screw. The screw may then be tightened until the head of the screw compresses the wire against the end of the stem to securely maintain the wire in place. It is appreciated that the wires may be connected in other ways, such as by clamps or by inserting the wire through a hole, and not depart from the present invention.

Figure 4:
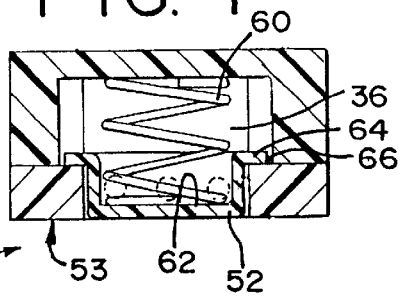
FIG. 4 is a transverse sectional view of the outlet box taken along line 4—4 of FIG. 3 showing the cover plate biased into closed position.

The top 22 of the outlet box is removably attached to the base as shown in FIGS. 2 and 3 with screws or bolts 50 to allow the cable to be inserted into and connected to the base. As shown in FIGS. 1 to 4, the top includes a retractable cover plate 52 for removably concealing the sockets 34. When not in use, the cover plate, in conjunction with the front surface 53 of the top provides a substantially uniform flat surface that protects people, especially children, from having access to the sockets of the outlet box. The cover plate 52, as shown in FIGS. 3 and 4, slidably fits within the cavity 36. It is appreciated there should be enough clearance between the cover plate and the cavity to allow for the cover plate to easily move within the cavity. A spring 60, connected to or placed between the base 20 and the underside 62 of the cover plate 52, acts to bias the cover plate 52 into closed position to conceal and close off access to the sockets 34, while a pair of flanges 64 on opposing sides of the cover plate 52, as shown in FIG. 4, coact with lips 66 on the base 20 to maintain the cover plate 52 within the cavity 36.

Turning now to the plug, the plug generally includes an insulated housing having a series of prongs that are electrically attached to the wires of an electric cable to allow for electricity to be conducted when the plug is mated with the wall outlet box. The housing of the plug is preferably molded of a suitably electrically insulating plastic such as a polypropylene or a rubber, but it is appreciated that it may be of any material suitable for use in an electrical connector. Additionally, the housing is preferably substantially L-shaped.

The housing of the plug includes a base 80 and a top 82. At one end 83 of the plug base 80 is a semi-circular area 84 that leads into a chamber 87 inside the base to accommodate an insulated electrical cable 86 within the base. A pair of wedges 88 and 89 coact to grip the cable 86 and prevent the cable from being pulled out of or separated from the plug. The wedges are preferably serrated on opposing sides, with the inside serrated sides 90 and 91 engaging the cable 86 and the outer serrated sides 92 and 93 engaging and mating with serrated angled walls 94 and 95 of the base. The wedges thus act to prevent movement of the cable and lock the cable to the plug to prevent disengagement of the wires from the prongs. The wedges also may accommodate electric cables of varying sizes by being removably positioned along the serrated angled walls.

Figure 6:
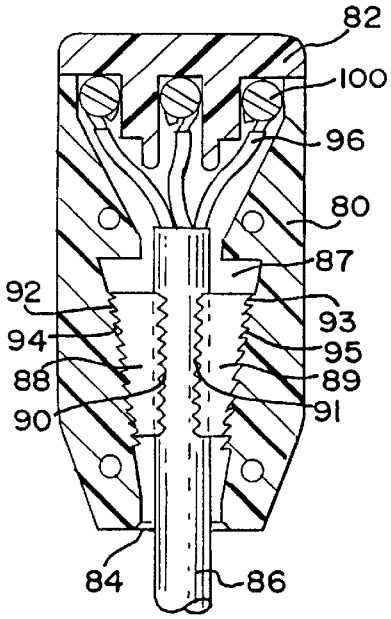
FIG. 6 is a vertical sectional view taken along line 6—6 of FIG. 5 showing the electric cable being securely held in place by a pair of wedges with opposed serrated faces.
Figure 7:
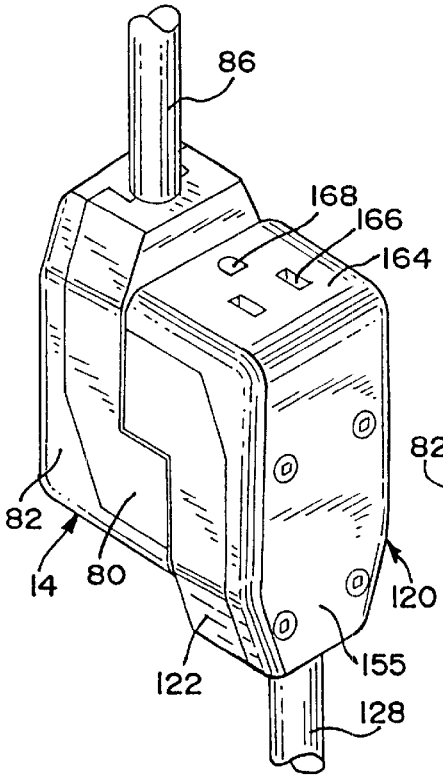
FIG. 7 is a perspective view of a modified electrical connector of the present invention showing a male connector member or plug on an electric cable in engagement with a female connector member or plug receptacle on another electric cable.
Figure 8:
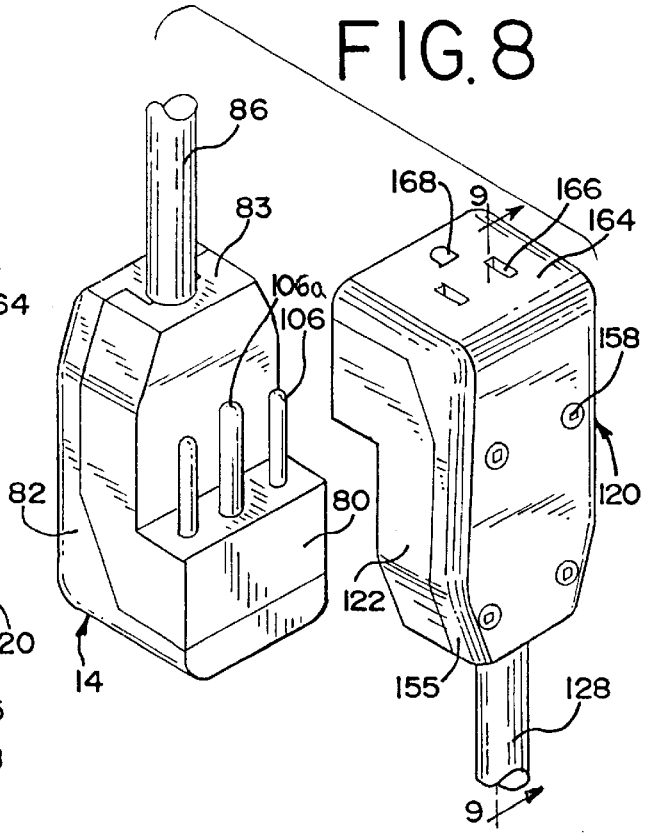
FIG. 8 is a perspective view of the male and female connector members in FIG. 7 in separated relation showing three prongs on the plug, and two slots and a socket on the top side of the plug receptacle for receiving a standard plug.

As shown in FIG. 6, the plug is shown on an electric cable carrying three wires, of which two wires are "hot" and one wire is a grounding wire. The wires 96 are connected to a series of contacts 98 by use of screws 100. Each contact is located within an L-shaped cavity 102 within the base and is comprised of a stem 104 and a prong 106. The stem of each contact has a threaded hole 108 for receiving the screw to make the electrical and mechanical connection. Similar to the electrical and mechanical connection made with the wires of the outlet box, the end of the wire—with the insulation of the wire removed—is wrapped around the screw or placed underneath the head 109 of the screw. The screw is then tightened down until it compresses the end of the wire to retain it in place. It is appreciated that the wires may be connected in other ways, such as by clamps or by inserting the wire through a hole, and not depart from the present invention.

Figure 5:
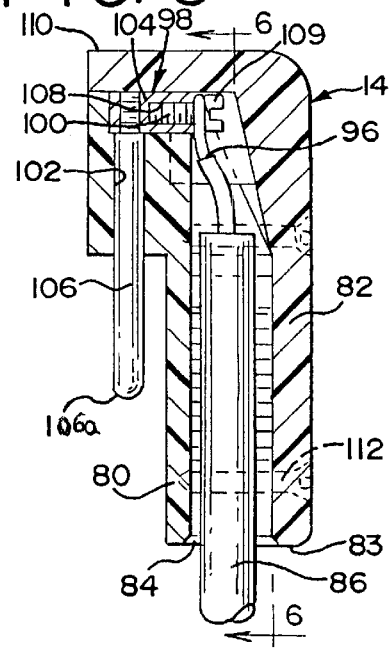
FIG. 5 is a vertical sectional view of the plug taken along line 5—5 of FIG. 2 showing a wire of an electric cable connected to one of the prongs of the plug.

The prongs 106 are cylindrical in shape with a rounded head **106*a* to facilitate entry into their respective sockets, although it is appreciated that the prongs may be of any cross-sectional shape to frictional fit within the respective sockets. While the prongs are illustrated as arranged in series, it is appreciated that the prongs may also be staggered depending on the arrangement of the sockets in the outlet box. As shown in FIGS. 2 and 5, the prongs extend from the back end 110 of the plug toward the front end 83** of the plug. Thus, when the prongs are inserted into their respective sockets, forces applied to the cable will not accidentally disengage the electrical connection.

The top 82 of the plug is removably attached to the base 80 as shown in FIGS. 4 and 5 with screws 112 to allow the cable to be inserted into the base and attached to the contacts. The end of the top also includes a semi-circular area coating with the opposed area on the base to accommodate the electric cable.

In operation, the wires from the electric cable are connected to the respective contacts on each of the connector members. The plug then is pressed against the cover of the outlet box, thereby compressing the spring and exposing the sockets of the outlet box. The prongs can then be pushed down into engagement with the sockets to provide an electrical connection. When inserted into their respective sockets, the prongs prevent disengagement of the electrical connection by being situated substantially perpendicular to the force applied to the cables. Removal of the plug requires disengagement of the prongs from the sockets and withdrawal of the plug from the outlet box cavity.

An alternate embodiment of the present invention is shown in FIGS. 7 to 11. The electric connector is shown having a male member or plug 14 as described above and a female member or plug receptacle 120. The female receptacle generally includes an insulated housing that is separated into a base and a top to allow for an electric cable to be placed inside the base and connected to the female member. The electric cable connects to a series of contacts that include sockets for accepting the prongs of the plug to create an electrical connection.

Figure 9:
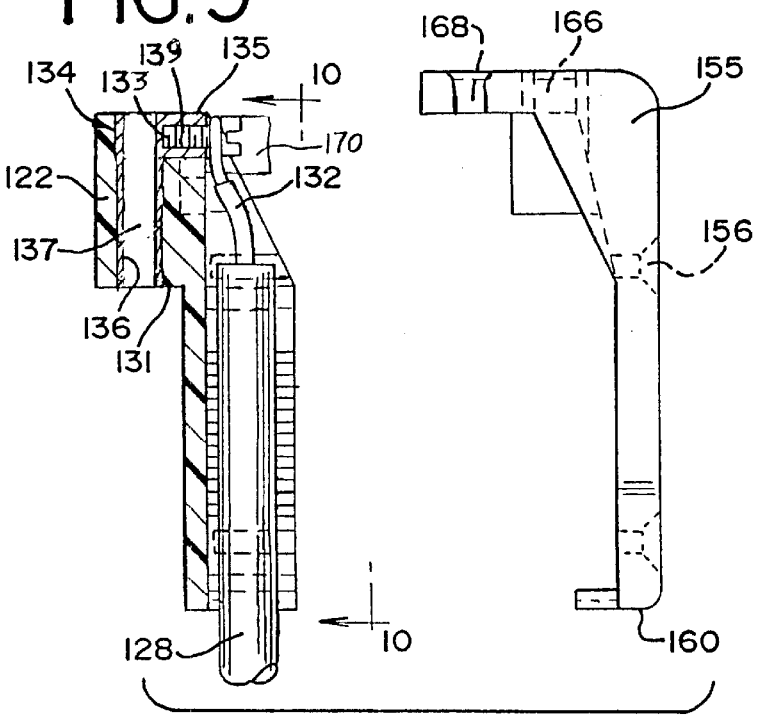
FIG. 9 is an exploded sectional view of the female connector member of FIG. 7 taken along line 9—9 of FIG. 8 showing the base in vertical section and the cover in vertical elevation showing the slots and the socket for receiving the standard plug.
Figure 10:
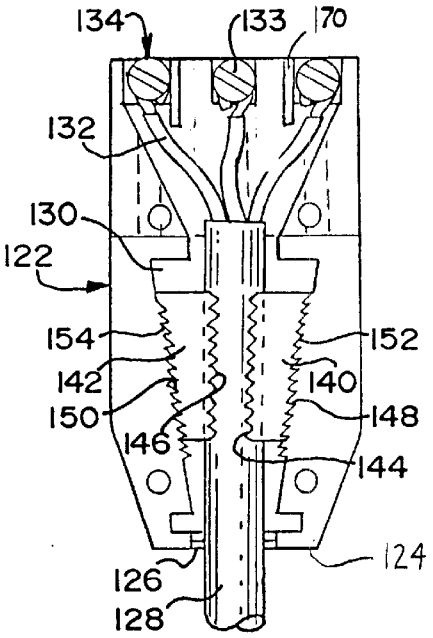
FIG. 10 is an elevational view of the base of FIG. 9 taken along line 10—10 of FIG. 9.
Figure 11:
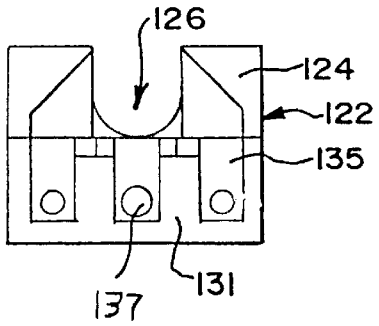
FIG. 11 is a bottom elevational view of the base of FIG. 10 showing the sockets for mating with the prongs and a semi-circular area for receiving the cable.

The base 122, as shown in FIGS. 9 and 10, is substantially L-shaped, but it is appreciated that it may be any other suitable shape. On the end 124 of the base 122 is a hole 126 to allow for the electric cable 128, which is shown as having three wires 132. An opening 130 in the base 122 allows the cable to be placed within the base and be connected to the contacts 134 by a series of screws 133. Each of the contacts, which are shown as substantially L-shaped but may be otherwise shaped, has a stem 135 and a contact base 136. The stem 135 of each contact 134 has a threaded hole 139 for receiving the screw 133 to make the electrical and mechanical connection as described above. It is appreciated that the wires may be connected in other ways, such as by clamps or by inserting the wire through a hole, and not depart from the present invention. A socket 137 runs through each of the contact bases 136 to the inner end 131 of the base to allow for a prong of the plug to be inserted into the socket for establishing an electrical connection. While the sockets are shown as substantially cylindrical in shape, it is appreciated that they may be of any cross-sectional shape to allow the prongs of the plug to frictionally fit within the respective sockets. When the prongs are mated with their respective sockets, any pulls on the electrical cables will act to drive the prongs into the socket so as to securely maintain the electrical connection.

A pair of wedges 140 and 142 in the base 122 coact to grip the cable 128 to prevent the cable from being pulled out of or separated from the female member. The wedges are preferably serrated on opposing sides, with the inside serrated sides 144 and 146 engaging the cable 128 and the outer serrated sides 148 and 150 engaging and mating with serrated angled walls 152 and 154 of the base 122. The wedges thus act to prevent movement of the cable and disengagement of the wires from the prongs. The wedges also may accommodate electric cables of varying sizes by being removably positioned along the serrated angled walls.

The top 155 has a series of holes 156 for accepting a number of screws 158 to attach the top to the base. Although screws are illustrated, it is appreciated that the top may be attached to the base using any suitable known means. The end 160 of the top may include a semi-circular portion (not shown) for receiving part of the cable 128. At the other end 164 of the top are a pair of parallel slotted holes 166 above a third hole 168 for receiving a standard three-prong plug (not shown) having two substantially flat blades and a substantially semi-circular prong. Alongside each of the slotted holes is a conductive plate 170 that abuts against the respective contact of the receptacle. When a standard plug is inserted into the receptacle, each of the two blades of the plug will touch a conductive plate and therefore be electrically connected to the contact. The substantially semi-circular prong of the plug fits within the middle socket 137, which extends through the base to accommodate either a prong from a standard plug or a prong from a plug of the present invention. It is appreciated that the holes on the receptacle may be of any shape and size to accommodate the blades and prongs of an electrical plug.

It will be understood that modifications and variations may be effected without departing from the scope of the novel concepts of the present invention, but it is understood that this application is limited only by the scope of the appended claims.

The invention is hereby claimed as follows:

1. An electrical connector comprising:

an outlet box mounted on a vertical wall, and a plug coacting with the outlet box to maintain an electrical connection, said outlet box including a housing, said housing having a recessed opening for receiving a portion of the plug and a plurality of sockets extending parallel to the wall and adjacent to a lower end of the recessed opening, said sockets being connected to an electric cable, said plug including a housing having a cable extending from the housing in a first direction and a plurality of prongs having free ends extending from the housing in said first direction and in substantially parallel relation to the cable, the plug being connected to the outlet by inserting the prongs into the recessed opening along a first path extending substantially perpendicular to the sockets, aligning the prongs with the sockets and engaging the prongs into the sockets by movement of the plug along a second path extending substantially parallel to the sockets and toward the cable of the plug, whereby a force on the plug cable away from the outlet will not separate the prongs from the sockets.

2. The electrical connector of claim 1, wherein the outlet box further includes means for automatically closing the recessed opening and access to the sockets when a plug is not mounted in the outlet box.

3. The electrical connector of claim 2, wherein said closing means includes a spring biased cover sized to the recessed opening.

4. The electrical connector of claim 3, wherein the recessed opening and the plug are sized such that movement of the plug into the opening for engaging the prongs in the sockets automatically retracts the cover to expose the sockets and aligns the prongs with the sockets for engagement therein upon movement of the plug prongs into the sockets.

* * * * *